United States Patent [19]

Sakata et al.

[11] Patent Number: 4,576,464

[45] Date of Patent: Mar. 18, 1986

[54] CHARGE ELIMINATING LAMP DEVICE

[75] Inventors: Hiromi Sakata, Neyagawa; Nobuhiko Kozuka, Suita; Hiroshi Hiraoka, Sakai, all of Japan

[73] Assignee: Mita Industrial Co., Ltd., Osaka, Japan

[21] Appl. No.: 682,763

[22] Filed: Dec. 17, 1984

[30] Foreign Application Priority Data

Dec. 28, 1983 [JP] Japan ..... 58-245438

[51] Int. Cl.[4] ..... G03G 15/00

[52] U.S. Cl. ..... 355/3 R; 355/3 CH; 355/14 CH; 355/14 E; 355/15; 355/67

[58] Field of Search ..... 355/3 R, 3 CH, 14 CH, 355/14 E, 15, 69, 67, 3 ER

[56] References Cited

U.S. PATENT DOCUMENTS

| | | | |
|---|---|---|---|
| 3,685,894 | 8/1972 | Lux et al. | 355/3 ER |
| 3,687,538 | 8/1972 | Matsumoto | 355/3 ER |
| 3,799,666 | 3/1974 | Fukushima et al. | 355/3 ER |
| 3,809,472 | 5/1974 | Liechty | 355/3 R |
| 4,082,450 | 4/1978 | Lehman | 355/69 X |
| 4,201,465 | 5/1980 | Oyama et al. | 355/15 |
| 4,265,998 | 5/1981 | Barkley | 355/15 X |
| 4,272,183 | 6/1981 | Maese et al. | 355/15 X |
| 4,408,865 | 10/1983 | Camis et al. | 355/3 CH |
| 4,477,179 | 10/1984 | Inuzuka et al. | 355/69 X |
| 4,534,641 | 8/1985 | Gilliland et al. | 355/3 R |

FOREIGN PATENT DOCUMENTS 55-95974 7/1980 Japan .

*Primary Examiner*—A. C. Prescott

*Attorney, Agent, or Firm*—Wenderoth, Lind & Ponack

[57] ABSTRACT

A charge eliminating lamp device, for use in an electrostatic copying apparatus, comprising a light shielding frame member having a light transmission opening formed on that surface which faces the surface of an electrostatographic material, a plurality of selectively energizable illuminating lamps disposed within the light shielding frame member in spaced-apart relationship in the width direction of the electrostatographic material, and a plurality of inside edge restricting light shielding walls disposed within the light shielding frame member and positioned adjacent to the insides of the illuminating lamps respectively as viewed in said width direction. The charge eliminating lamp device includes selectively energizable auxiliary lamps disposed among said illuminating lamps as viewed in said width direction. Alternatively, a partitioning light shielding wall is disposed within the frame member extending in said width direction for partitioning the inside of the frame member into two sections in the moving direction of the electrostatographic material, and the illuminating lamps and the inside edge restricting light shielding walls are disposed alternately in one and the other of the two sections. Alternatively, auxiliary light transmission openings are formed in at least one of the front and rear walls of the frame member located frontwardly and rearwardly as viewed in the moving direction of the electrostatographic material.

19 Claims, 10 Drawing Figures

CHARGE ELIMINATING LAMP DEVICE

FIELD OF THE INVENTION

This invention relates to a charge eliminating lamp device for use in an electrostatic copying apparatus. More specifically, it relates to a charge eliminating lamp device for use in an electrostatic copying apparatus, which irradiates light to one or both side portions of a charged electrostatographic material to erase the charge and thus to adjust the width of the charged area of the electrostatographic material to a desired value.

DESCRIPTION OF THE PRIOR ART

It is well known that in a so-called transfer-type electrostatic copying apparatus, an electrostatographic material is charged to a specific polarity, and then exposed to light through a document to be copied, whereby a latent electrostatic image corresponding to the image of the document is formed on the electrostatographic material. The latent electrostatic image is developed to a toner image which is then transferred to a copying paper sheet (in a toner image transfer type electrostatic copying apparatus). Or the latent electrostatic image on the electrostatographic material is first transferred to a copying paper sheet and then developed to a toner image (in a latent electrostatic image transfer type electrostatic copying apparatus).

In the transfer-type electrostatic copying apparatus, it is generally desired to change the width of the latent electrostatic image or the toner image formed on the electrostatographic material according to the width of a copying paper used. For example, if the toner image formed on the electrostatographic material has a width larger than that of the copying paper, one or both side portions of the toner image remain on the electrostatographic material without being transferred at all to the copying paper in the transfer step. The remaining one or both side portions are removed only insufficiently from the electrostatographic material in the cleaning step performed after the transfer step. The remaining toner will adversely affect the next copying cycle.

To change the width of the latent electrostatic image or the toner image formed on the electrostatographic material according to the width of the copying paper used, it may be possible to change the width of the charged area of the electrostatographic material according to the width of the copying paper in the charging of the electrostatographic material to be performed prior to exposure of the image of a document. However, it is generally considerably difficult, if not impossible, to change the width of the charged area of the electrostatographic material properly according to the width of the copying paper in the step of charging the electrostatographic material by a coronal discharge device. It is the usual practice therefore to charge substantially the entire width of the electrostatographic material substantially uniformly and thereafter irradiating light onto one or both side portions of the charged electrostatographic material, thereby erasing the charge and thus adjusting the width of the charged area to the desired value.

A charge eliminating lamp device has been used to irradiate light onto one or both side portions of the charged electrostatographic material and erase the charge. The charge eliminating lamp device includes a light shielding frame member positioned in proximity to at least one side portion of the surface of the electrostatographic material and having a light transmission opening formed on that surface thereof which is opposite to the surface of the electrostatographic material, and a plurality of selectively energizable illuminating lamps disposed within the light shielding frame member and spaced from each other in the width direction of the electrostatographic material. Within the light shielding frame member are disposed a plurality of inside edge restricting light shielding walls adjacent respectively to the insides of the illuminating lamps as viewed in the width direction of the electrostatographic material. Each of the inside edge restricting light shielding walls restricts the inside edge, in the width direction of the electrostatographic material, of a light-irradiated area formed on the electrostatographic material by an illuminating lamp located outwardly thereof. In the charge eliminating lamp device described above, the illuminating lamps are selectively energized according, for example, to the width of a copying paper used, and light is irradiated onto an area outwardly of a predetermined position, in the width direction, of one side edge portion or both side edge portions of the electrostatographic material to erase the charge on that area.

It is desired in the above charge eliminating lamp device to restrict fully sharply the inside edge, in the width direction, of the aforesaid light-irradiated area (therefore, the charge-eliminated area) of the electrostatographic material by each of the above inside edge restricting light shielding walls and thus to define the boundary between the charged area and the charge-eliminated area on the electrostatographic material. If the boundary is not sharp enough, it will be readily understood that the outside edge portion, in the width direction, of a latent electrostatic image or a toner image formed on the electrostatographic material becomes vague, or the charge is not fully eliminated from the inside edge portion, in the width direction, of the charge-eliminated area. If with the conventional charge eliminating lamp device, one attempts to cause each inside edge restricting light shielding wall to restrict sharply the inside edge, in the width direction, of a light-irradiated area formed on the electrostatographic material by an illuminating lamp located outwardly of the inside edge restricting light shielding wall, the outside edge, in the width direction, of a light-irradiated area formed on the electrostatographic material by an illuminating lamp located inwardly of the inside edge restricting light shielding wall will be restricted to a site inwardly of the inside edge of the light-irradiated area formed by the aforesaid outwardly located illuminating lamp. Consequently, unallowable problems arise in that an insufficiently light-irradiated portion corresponding to the inside edge restricting light shielding wall is formed on that area of the electrostatographic material which is to be light-irradiated, and therefore, an insufficiently charge-eliminated portion corresponding to the aforesaid restricting light shielding wall is formed on that area of the electrostatographic material from which the charge is to be eliminated. Accordingly, in the conventional charge eliminating lamp device, each inside edge restricting light shielding wall cannot sharply enough restrict and define the inside edge of a light-irradiated area formed on the electrostatographic material by an illuminating lamp located outwardly thereof, and therefore, the boundary between the charged area and the charge-eliminated area on the electrostatographic material cannot be defined fully sharply.

SUMMARY OF THE INVENTION

It is a first object of this invention therefore to provide an improved charge eliminating lamp device by which each of the aforesaid inside edge restricting light shielding walls can restrict fully sharply as desired the inside edge of a light-irradiated area formed on the electrostatographic material by an illuminating lamp located outwardly thereof without forming an insufficiently light irradiated portion on that area of the electrostatographic material which is to be irradiated and therefore without forming an insufficiently charge-eliminated portion on that area of the electrostatographic material from which the charge is to be eliminated, and consequently the boundary between the charged area and the charge-eliminated area can be defined fully sharply.

A second object of this invention is to provide a further improved charge eliminating lamp device which can achieve the first object without the need for any additional lamp.

A third object of this invention is to provide a further improved charge eliminating lamp device which can achieve the first and second objects without the need to build it in a large size.

According to this invention, the first object is achieved by a charge eliminating lamp device comprising a light shielding frame member positioned in proximity to at least one side portion of the surface of an electrostatographic material from which an electric charge is to be eliminated, said frame member having a light transmission opening at that surface which faces the surface of the electrostatographic material, a plurality of illuminating lamps adapted to be selectively energized and disposed within said frame member in spaced-apart relationship in the width direction of the electrostatographic material, and a plurality of inside edge restricting light shielding walls within said frame member, said inside edge restricting light shielding walls being positioned adjacent to the insides of said illuminating lamps respectively as viewed in said width direction and adapted to restrict the inside edges, in said width direction, of light-irradiated areas formed on the electrostatographic material by said illuminating lamps; wherein each said inside edge restricting light shielding wall restricts the outside edge, in said width direction, of a light-irradiated area formed on the electrostatographic material by an illuminating lamp located inwardly of said inside edge restricting light shielding wall as viewed in said width direction to a site inwardly of the inside edge, in said width direction, of a light-irradiated area formed on the electrostatographic material by an illuminating lamp located outwardly of said inside edge restricting light shielding wall, and selectively energizable auxiliary lamps are disposed among said illuminating lamps in said width direction for irradiating an area on the electrostatographic material which ranges from its inside edge positioned between the inside edge and outside edge, in said width direction, of a light-irradiated area formed on the electrostatographic material by an illuminating lamp located inwardly of each said inside edge restricting light shielding wall in said width direction to its outside edge positioned at, or outwardly of, the inside edge, in said width direction, of a light-irradiated area formed on the electrostatographic material by an illuminated lamp located outwardly of said inside edge restricting light shielding wall in said width direction.

The second object of this invention is achieved in accordance with this invention by a charge eliminating lamp device comprising a light shielding frame member positioned in proximity to at least one side portion of the surface of an electrostatographic material from which an electric charge is to be eliminated, said frame member having a light transmission opening at that surface which faces the surface of the electrostatographic material, a plurality of illuminating lamps adapted to be selectively energized and disposed within said frame member in spaced-apart relationship in the width direction of the electrostatographic material, and a plurality of inside edge restricting light shielding walls within said frame member, said inside edge restricting light shielding walls being positioned adjacent to the insides of said illuminating lamps respectively as viewed in said width direction and adapted to restrict the inside edges, in said width direction, of light-irradiated areas formed in the electrostatographic material by said illuminating lamps; wherein a partitioning light shielding wall extending in said width direction is disposed in said frame member for partitioning the inside of said frame member into two sections in the moving direction of the electrostatographic materials; and said illuminating lamps and inside edge restricting light walls are disposed alternately in one and the other of said two sections, and the outside edge, in said width direction, of a light-irradiated area formed on the electrostatographic material by one of two illuminating lamps adjoining in said width direction which is located inwardly in said width direction is restricted to, or outwardly of, the inside edge, in said width direction, of a light-irradiated area formed on the electrostatographic material by the other illuminating lamp located outwardly in said width direction.

According to this invention, the third object is achieved by a charge eliminating lamp device comprising a light shielding frame member positioned in proximity to at least one side portion of the surface of an electrostatographic material from which an electric charge is to be eliminated, said frame member having a light transmission opening at that surface which faces the surface of the electrostatographic material, a plurality of illuminating lamps adapted to be selectively energized and disposed within said frame member in spaced-apart relationship in the width direction of the electrostatographic material, and a plurality of inside edge restricting light shielding walls within said frame member, said inside edge restricting light shielding walls being positioned adjacent to the insides of said illuminating lamps respectively as viewed in said width direction and adapted to restrict the inside edges, in said width direction, of light-irradiated areas formed on the electrostatographic material by said illuminating lamps; wherein one or more auxiliary light transmission openings are formed in at least one of the front and rear walls of said frame member which are located forwardly and rearwardly as viewed in the moving direction of the electrostatographic material, and the outside edge, in said width direction, of a light-irradiated area formed on the electrostatographic material by the light coming from an illuminating lamp located inwardly of each said inside edge restricting light shielding wall in said width direction through said light transmission opening is restricted by said inside edge restricting light shielding wall to a site inwardly of the inside edge, in said width direction, of a light-irradiated area formed on the electrostatographic material by the light coming from an illuminating lamp located outwardly of said inside edge restricting light shielding wall through said light transmission opening, but a light-irradiated area formed on the electrostatographic material by the light coming from an illuminating lamp located inwardly of each said inside edge restricting light shielding wall as viewed in said width direction through said auxiliary light transmission opening extends from its inside edge positioned between the inside edge and outside edge, in said width direction, of a light-irradiated area formed on the electrostatographic material by the light coming from an illuminating lamp located inwardly of each said inside edge restricting light shielding wall as viewed in said width direction through said light transmission opening to its outside edge positioned at, or outwardly of, the inside edge, in said width direction, of a light irradiated area formed on the electrostatographic material by the light coming from an illuminating lamp located outwardly of said inside edge restricting light shielding wall as viewed in said width direction through said light transmission opening.

DETAILED DESCRIPTION OF PREFERRED EMBODIMENTS

The invention will now be described in detail with reference to the accompanying drawings.

Figure 1:
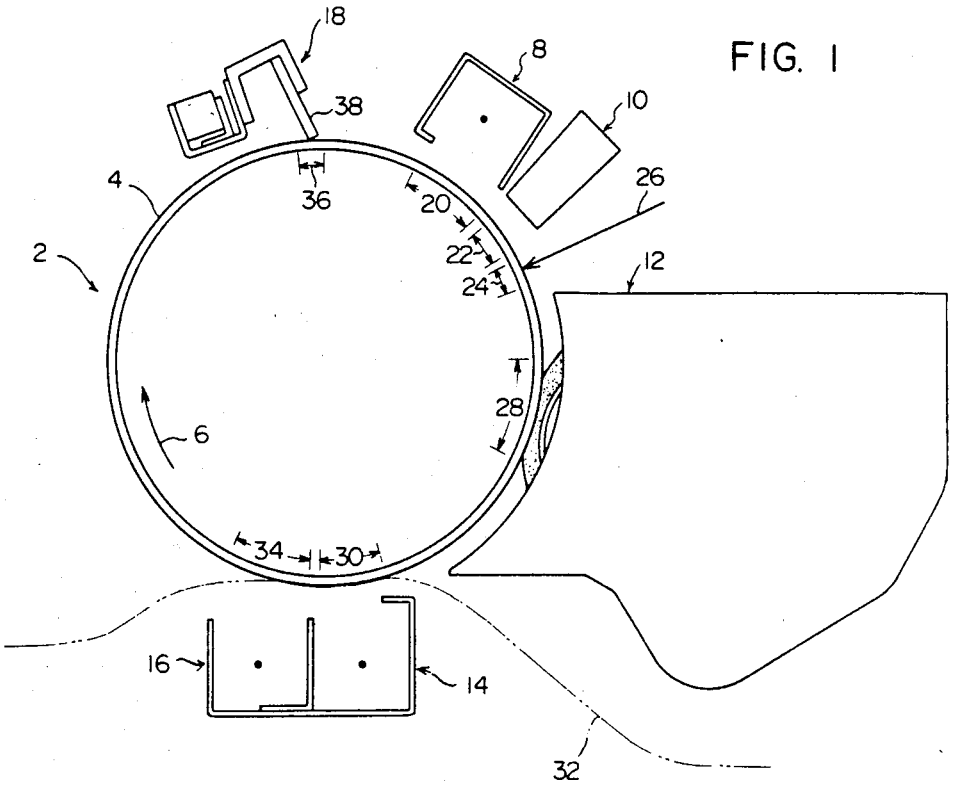
FIG. 1 is a simplified view showing the principal parts of a toner image transfer-type electrostatic copying apparatus.

With reference to FIG. 1 showing in a simplified form the principal parts of a toner image transfer-type electrostatic copying apparatus, the illustrated copying apparatus has a cylindrical rotating drum 2 rotatably mounted. An electrostatographic material 4 is disposed on the peripheral surface of the drum 2. Around the rotating drum 2 are disposed a charging corona discharge device 8, a charge eliminating lamp device 10, a developing device 12, a transfer corona discharge device 14, a peeling corona discharge device 16 and a cleaning device 18 successively in the rotating direction shown by an arrow 6.

In this type of copying apparatus, the electrostatographic material 4 is substantially uniformly charged to a specified polarity over its substantially entire width by the action of the charging corona discharge device 8 in a charging zone shown at 20 while the rotating drum 2 is rotated in the direction of arrow 6. Then, in a charge eliminating zone shown at 22, light is irradiated onto one or both side portions of the electrostatographic material 4 by the action of the charge eliminating lamp device 10 to erase the electric charge therefrom. Thus, that area on the electrostatographic material 4 which has an electric charge i.e. a charged area, is adjusted to a required width, for example to a size substantially conforming to the width of a copying paper used. (The structure, operation and effect of the charge eliminating lamp device 10 will be described in greater detail hereinafter.) Thereafter, in en exposing zone shown at 24, the image of a document (not shown) to be copied is scanned and exposed on the electrostatographic material 4 as shown by an arrow 26 by the action of a suitable optical unit (not shown), and the charge on the electrostatographic material is erased in a pattern corresponding to the image of the document. Consequently, a latent electrostatic image corresponding to the image of the document is formed on the electrostatographic material 4. Then, in a developing zone shown at 28, a toner is applied to the electrostatographic material 4 by the action of the developing device which may be of a known type such as a magnetic brush type to develop the latent electrostatic image to a toner image. In a transfer zone shown at 30, a copying paper conveyed in the direction shown by a two-dot chain line 32 in synchronism with the rotation of the rotating drum is contacted with the surface of the electrostatographic material 4 and the toner image on the electrostatographic material 4 is transferred to the copying paper by the action of the transfer corona discharge device 14. Thereafter, in a peeling zone shown at 34, the copying paper is peeled from the surface of the electrostatographic material by the action of the peeling corona discharge device 16. The peeled copying paper is conveyed through a suitable fixing means (not shown) to fix the toner image to the copying paper. As a result, a copy having a fixed toner image corresponding to the image of the document is obtained. In the meantime, the rotating drum 2 continues to rotate, and in a cleaning zone shown at 36, the toner remaining on the electrostatographic material 4 after the transfer is removed by the action of the cleaning device 18 of a suitable type which may be one having a cleaning blade 38 adapted to be in press contact with the surface of the electrostatographic material 4.

The structure and action of the electrostatic copying apparatus described above are well known, and only show one example to which the charge eliminating lamp device improved in accordance with this invention is applied. Accordingly, details of the structures and actions of parts other than the charge eliminating device 10 in the illustrated electrostatic copying apparatus are omitted in the present specification.

The present invention relates to an improvement in the charge eliminating lamp device 10 used in the aforesaid electrostatic copying apparatus. For a better understanding of the present invention, one example of the conventional charge eliminating lamp device will be briefly described with reference to FIGS. 2 and 3 prior to describing specific embodiments of the charge eliminating lamp device constructed in accordance with this invention.

Figure 2:
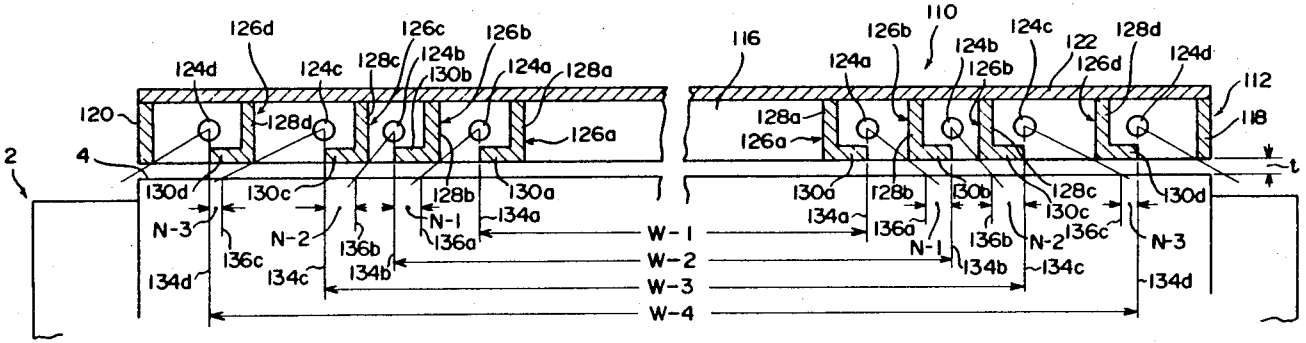
FIG. 2 is a sectional view showing a conventional charge eliminating lamp device.
Figure 3:
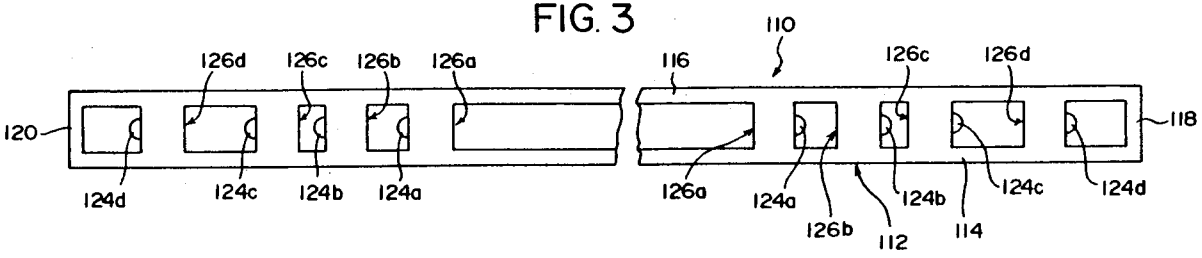
FIG. 3 is a bottom view of the charge eliminating lamp device of FIG. 2.

One embodiment of the conventional charge eliminating lamp device shown generally at 110 in FIGS. 2 and 3 has a light shielding frame member 112. The light shielding frame member 112 supported in position by a suitable supporting means (not shown) extends widthwise (i.e., in the left-right direction in FIGS. 2 and 3) along the surface of the electrostatographic material 4 substantially parallel to its entire width. The light shielding frame member 112 includes a front wall 114 and a rear wall 116 located on the front and rear side respectively as viewed in the moving direction (the vertical direction in FIG. 3) of the electrostatographic material 4 and side walls 118 and 120 located on opposite sides in the width direction. The under surface of the light shielding frame member 112 in FIG. 2, i.e. that surface which faces the surface of the electrostatographic material 4, is opened and defines a light transmission opening permitting transmission of light.

A plurality of (four in the drawings) illuminating lamps 124*a*, 124*b*, 124*c* and 124*d* are supported by a suitable supporting means (not shown) at suitable intervals in the widthwise direction in each of the two side portions of the light shielding frame member 112. Furthermore, in each of the two side portions of the light shielding frame member 112, a plurality of inside edge restricting light shielding walls 126*a*, 126*b*, 126*c* and 126*d* are disposed adjacent to the insides of the illuminating lamps 124*a*, 124*b*, 124*c* and 124*d*, respectively. The inside edge restricting light shielding walls 126*a*, 126*b*, 126*c* and 126*d* respectively have first portions 128*a*, 128*b*, 128*c* and 128*d* extending toward, and substantially perpendicularly to, the surface of the electrostatographic material 4 and second portions 130*a*, 130*b*, 130*c* and 130*d* extending outwardly of the forward ends (i.e., the lower ends in FIG. 2) of the first portions 128*a*, 128*b*, 128*c* and 128*d* in the widthwise direction substantially parallel to the surface of the electrostatographic material 4. Conveniently, the outside ends, in the width direction, of the second portions 130*a*, 130*b*, 130*c* and 130*d* of the inside edge restricting light shielding walls 126*a*, 126*b*, 126*c* and 126*d* respectively are substantially aligned respectively with the light emitting centers of the illuminating lamps 124*a*, 124*b*, 124*c* and 124*d* as viewed in a direction substantially perpendicular to the surface of the electrostatographic material 4.

When in the charge eliminating lamp device 110 described above, a copying paper used has a width shown by symbol W-1 in FIG. 2 (for example, the length of the shorter side of the B5 size stipulated in JIS), all of the illuminating lamps 124*a*, 124*b*, 124*c* and 124*d* are energized, and light beams from these illuminating lamps are irradiated onto the electrostatographic material 4 through the light transmitting opening at the under surface of the light shielding frame member 112. As shown in FIG. 2, the widthwise inside edge 134*a* of a light-irradiated area formed on the electrostatographic material 4 by the light emitted from the illuminating lamp 124*a* located innermost is restricted to a position in alignment with the outside edge, in the width direction, of the width W-1 by the inside edge restricting light shielding wall 126*a* located inwardly of the illuminating lamp 124*a* as viewed in the widthwise direction. As a result, an area having the above width W-1 on the electrostatographic material is not irradiated, and therefore, the charge therein is not erased. But light is irragiated on an area outwardly of the width W-1 in the width direction and the charge therein is erased (although as will be stated below, there could be an area in which light irradiation is not sufficient and therefore the erasing of the charge is not sufficient). Consequently, the width of the charged area on the electrostatographic material is brought into agreement with the width W-1. When the copying paper used has a width shown by symbol W-2 in FIG. 2 (for example, the length of the shorter side of the A4 size stipulated in JIS), the innermost illuminating lamp 124*a* is not energized, but the remaining lamps 124*b*, 124*c* and 124*d* are energized. The light beams from the energized lamps 124*b*, 124*c* and 124*d* are irradiated onto the electrostatographic material 4 through the light transmission opening. As shown in FIG. 2, the inside edge 134*b*, in the width direction, of a light-irradiated area formed on the electrostatographic material 4 by the light from the illuminating lamp 124*b* located innermost among the lamps 124*b*, 124*c* and 124*d* is restricted to a position in alignment with the outside edges, in the width direction, of the width W-2 by the inside edge restricting light shielding wall 126*b* located inwardly of the illuminating lamp 124*b* as viewed in the widthwise direction. Consequently, light is not irradiated on the area having the width W-2 on the electrostatographic material 4 and the charge is not erased. But an area outwardly of the width W-2 in the width direction is irradiated with light, and the charge therein is erased (although, as will be stated below, there could be an area in which light irradiation is not sufficient and therefore the erasing of the charge is not sufficient). As a result, the width of the charged area on the electrostatographic material 4 is brought into agreement with the width W-2. When the copying paper used has a width shown by symbol W-3 (for example, the length of the shorter side of the B4 size stipulated in JIS), the illuminating lamps 124*a* and 124*b* are not energized, but the remaining lamps 124*c* and 124*d* are energized. The light beams from the energized lamps 124*c* and 124*d* are irradiated onto the electrostatographic material 4 through the light transmission opening. It will be seen from FIG. 2 that the inside edge 134*c*, in the width direction, of a light-irradiated area formed on the electrostatographic material 4 by the light from the illuminating lamp 124*c* located more inwardly than the lamp 124*d* is restricted to a position in alignment with the outside edge, in the width direction, of the width W-3 by the inside edge restricting light shielding wall 126*c* located inwardly of the lamp 124*c* as viewed in the width direction. Consequently, an area having the width W-3 on the electrostatographic material 4 is not irradiated with light, and therefore the charge therein is not erased, but an area outwardly of the width W-3 in the width direction is irradiated with light and therefore, the charge therein is erased (although as will be stated below, there could be an area in which light irradiation is not sufficient and therefore the erasing of the charge is not sufficient). As a result, the width of the charged area on the electrostatographic material 4 is brought into agreement with the width W-3. When the copying paper used has a width shown by symbol W-4 (for example, the length of the shorter side of the A3 size stipulated in JIS), the illuminating lamps 124*a*, 124*b* and 124*c* are not energized and only the lamps 124*d* are energized. The light beams from the energized lamps 124*d* are irradiated onto the electrostatographic material 4 through the light transmission opening. It will be seen from FIG. 2 that the inside edge 134*d*, in the width direction, of a light-irradiated area formed on the electrostatographic material 4 by the light from the energized lamp 124*d* is restricted to a position in alignment with the outside edge, in the width direction, of the width W-4 by the inside edge restricting light shielding wall 126*d* located inwardly of the lamp 124*d* as viewed in the widthwise direction. Consequently, an area having the width W-4 on the electrostatographic material 4 is not irradiated with light, and the charge therein is not erased, but an area outwardly of the width W-4 in the width direction is irradiated with light and the charge therein is erased. As a result, the width of the charged area on the electrostatographic material 4 is brought into agreement with the width W-4.

The conventional charge eliminating lamp device 110 has the following problems to be solved. When a charged area on the electrostatographic material 4, i.e. an area in which light is not irradiated and the charge is not erased, is to be restricted to an area having the width of W-1, W-2, W-3 or W-4 in conformity to the width of a copying paper used, it is important to define the outside edge, in the width direction, of the charged area W-1, W-2, W-3 or W-4 sharply. To this end, it is important to restrict sharply the inside edges 134*a*, 134*b*, 134*c* and 134*d*, in the width direction, of the light-irradiated area on the electrostatographic material 4 by the inside edge restricting light shielding walls 126*a*, 126*b*, 126*c* and 126*d* respectively. To meed this requirement, it is necessary to position the charge eliminating lamp device 110 close enough to the surface of the electrostatographic material 4. If, however, the conventional charge eliminating lamp device 110 is positioned close enough to the surface of the electrostatographic material 4, the following unallowable problems arise. As shown in FIG. 2, the outside edge 136*a*, in the width direction, of the light-irradiated area formed on the electrostatographic material 4 by the light from the lamp 124*a* is restricted to a position inwardly of the inside edge 134*d*, in the width direction, of the light-irradiated area formed on the electrostatographic material 4 by the light from the lamp 124*b*, by means of the inside edge restricting light shielding wall 126*b* located outwardly of the lamp 124*a*. The outside edge 136*b*, in the width direction, of the light-irradiated area formed on the electrostatographic material 4 by the light from the illuminating lamp 124*b* is restricted to a position inwardly of the inside edge 134*c*, in the width direction, of the light-irradiated area formed on the electrostatographic material 4 by the light from the illuminating lamp 124*c*, by means of the inside edge restricting light shielding wall 126*c* located outwardly of the illuminating lamp 124*b*. The outside edge 136*c*, in the width direction, of the light-irradiated area formed on the electrostatographic material 4 by the light from the illuminating lamp 124*c* is restricted to a position inwardly of the inside edge 134*d*, in the width direction, of the light-irradiated area formed on the electrostatographic material 4 by the light from the illuminating lamp 124*d*, by means of the inside edge restricting light shielding wall 126*d* located outwardly of the illuminating lamp 124*c*. Consequently, insufficiently light-irradiated portions N-1, N-2 and N-3 are generated. Accordingly, when all of the illuminating lamps 124*a* to 124*d* are energized to adjust the width of the charged area on the electrostatographic material 4 to W-1, the electric charge on the electrostatographic material 4 is not fully erased at the insufficiently light-irradiated portions N-1, N-2 and N-3 outwardly of the width W-1, and these portions become insufficiently charge-eliminated portions. When the illuminating lamps 124*b*, 124*c* and 124*d* are energized to adjust the width of the charged area on the electrostatographic material 4 to W-2, the electric charge on the electrostatographic material 4 is not fully erased at the insufficiently light-irradiated portions N-2 and N-3 outwardly of the width W-2, and these portions become insufficiently charge-eliminated portions. When the illuminating lamps 124*c* and 124*d* are energized to adjust the width of the charged area on the electrostatographic material 4 to W-3, the electric charge on the electrostatographic material 4 is not fully erased at the insufficiently light-irradiated portion N-3 outwardly of the width W-3 and this portion becomes an insufficiently charge-eliminated portion.

To avoid the formation of the insufficiently light-irradiated portions N-1, N-2 and N-3, it is necessary to position the charge eliminating lamp device 110 apart from the surface of the electrostatographic material 4 and to increase the distance t between them, or to shorten the widthwise outwardly projecting lengths of the second portions 130*a*, 130*b*, 130*c* and 130*d* of the inside edge restricting light shielding walls 126*a*, 126*b*, 126*c* and 126*d*, respectively. It will be easily understood however that if such measures are taken, the inside edges 134*a*, 134*b*, 134*c* and 134*d*, in the width direction, of the light-irradiated areas formed on the electrostatographic material 4 by the illuminating lamps 124*a*, 124*b*, 124*c* and 124*d*, which are restricted by the inside edge restricting light shielding walls 126*a*, 126*b*, 126*c* and 126*d* respectively, become dull, and therefore, the outside edge, in the width direction, of the charged area W-1, W-2, W-3 or W-4 on the electrostatographic material 4 becomes dull.

Figures 4, 5:
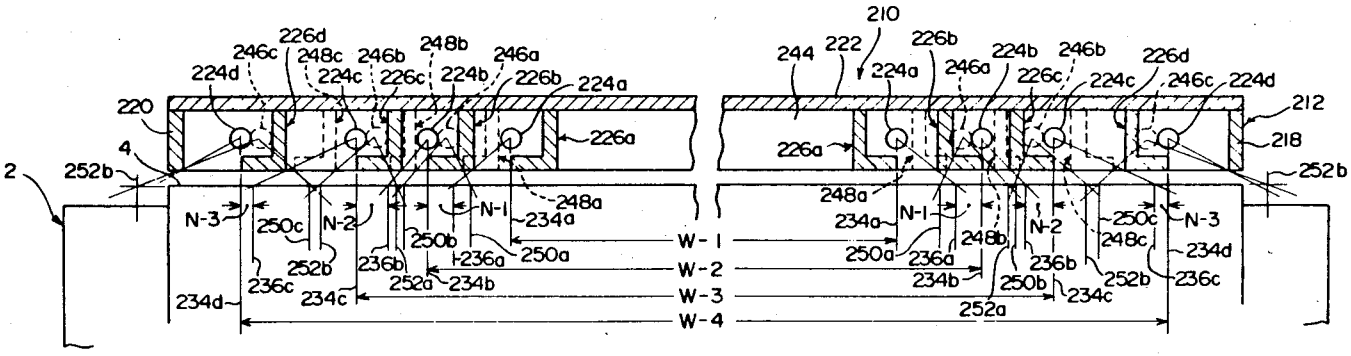
FIG. 4 is a sectional view showing a first embodiment of the charge eliminating lamp device improved in accordance with this invention.
FIG. 5 is a bottom view of the charge eliminating lamp device of FIG. 4.

FIGS. 4 and 5 illustrate a first embodiment of the charge eliminating lamp device improved in accordance with this invention, which is free from the aforesaid problems of the conventional charge eliminating lamp device described hereinabove with reference to FIGS. 2 and 3.

The charge eliminating lamp device shown generally at 210 has a light shielding frame member 212 supported in position by a suitable supporting means (not shown). The light shielding frame member 212 extends widthwise (i.e., in the left-right direction in FIGS. 4 and 5) along the surface of the electrostatographic material 4 substantially parallel to its nearly entire width. The light-shielding frame member 212 has a front wall 214 and a rear wall 216 positioned on the front and rear sides respectively as viewed in the moving direction (the vertical direction in FIG. 5) of the electrostatographic material 4 and side walls 218 and 220 positioned on opposite sides in the width direction. The upper surface, as shown in FIG. 4, of the light shielding frame member 212 is closed by a cover plate 222. The lower surface of the light shielding frame member 212 in FIG. 4, i.e. that surface which faces the surface of the electrostatographic material 4, is closed to define a light transmission opening permitting transmission of light.

Within the light shielding frame member 212 is disposed a partitioning light shielding wall 244 extending widthwise along the entire width of the electrostatographic material 4 to partition the inside of the light shielding frame member 212 in the moving direction of the electrostatographic material 4 into a first section 240 and a second section 242. Within each side portions of the first section 240, a plurality of (four in the drawings) properly widthwise spaced illuminating lamps 224*a*, 224*b*, 224*c* and 224*d* are supported by a suitable supporting means (not shown). Furthermore, in each of the side portions of the first section 240, a plurality of inside edge restricting light shielding walls 226*a*, 226*b*, 226*c* and 226*d* are disposed adjacent to the insides of the illuminating lamps 224*a*, 224*b*, 224*c* and 224*d*, respectively. The structures and actions of the illuminating lamps 224*a*, 224*b*, 224*c* and 224*d* and the inside edge restricting light shielding walls 226*a*, 226*b*, 226*c* and 226*d* are substantially the same as those of the illuminating lamps 124*a*, 124*b*, 124*c* and 124*d* and the inside edge restricting light shielding walls 126*a*, 126*b*, 126*c* and 126*d* of the conventional charge eliminating lamp device 110 described hereinabove with reference to FIGS. 2 and 3.

A plurality of (three in the drawings) properly widthwise spaced auxiliary lamps 246*a*, 246*b*, 246*c* are supported by a suitable supporting means (not shown) in each of the side portions of the second section 242 of the light shielding frame member 212. As viewed in the width direction of the electrostatographic material 4, the auxiliary lamp 246*a* is positioned between the illuminating lamps 224*a*, and 224*b*; the auxiliary lamp 246*b*, between the illuminating lamps 224*b* and 224*c*; and the auxiliary lamp 246*c*, between the illuminating lamps 224*c* and 224*d*.

A plurality of auxiliary inside edge restricting light shielding walls 248*a*, 248*b* and 248*c* are disposed in each of the side portions of the second section 242 inwardly of the auxiliary lamps 246*a*, 246*b* and 246*c*, respectively. As viewed in the width direction of the electrostatographic material 4, the auxiliary inside edge restricting light shielding wall 248*a* is positioned between the inside edge restricting light shielding walls 226*a* and 226*b*; the auxiliary inside edge restricting light shielding wall 248*b*, between the inside edge restricting light shielding walls 226*b*, and 226*c*; and the auxiliary inside edge restricting light shielding wall 248*c*, between the inside edge light-shielding walls 226*c* and 226*d*. Each of the auxiliary light shielding walls 248*a*, 248*b* and 248*c* may be of nearly the same type as each of the light shielding walls 226*a*, 226*b*, 226*c* and 226*d*.

It is important in the above charge eliminating lamp device 210, the inside edge 250*a* of the light-irradiated area formed on the electrostatographic material 4 by the light beam leading from the auxiliary lamp 246*a* to the electrostatographic material 4 through the light transmission opening of the light shielding frame member 212 should be restricted within the light-irradiated area formed on the electrostatographic material 4 by the light from the illuminating lamp 224*a*, namely to a suitable position between the inside edge 234*a* and the outside edge 236*a* thereof, and the outside edge 252*a* of the light irradiated area formed on the electrostatographic material 4 by the light from the auxiliary lamp 246*a* should be on, or outwardly of, the inside edge 234*b* of the light-irradiated area formed on the electrostatographic material 4 by the light from the illuminating lamp 224*b*, as shown in FIG. 4. In the illustrated embodiment, the outside edge 252*a* of the light-irradiated area formed on the electrostatographic material 4 by the light from the auxiliary lamp 246*a* is restricted within the light-irradiated area formed on the electrostatographic material 4 by the light from the illuminating lamp 224*b*, that is, to a suitable position between the inside edge 234*b* and the outside edge 236*b* thereof, by the auxiliary inside edge restricting light shielding wall 348*b* located outwardly of the auxiliary lamp 246*a*. Likewise, it is important that the inside edge 250*b* of the light-irradiated area formed on the electrostatographic material 4 by the light leading from the auxiliary lamp 246*b* to the electrostatographic material is restricted within the light-irradiated area formed on the electrostatographic material 4 by the light from the illuminating lamp 224*b*, namely to a suitable position between its inside edge 234*b* and its outside edge 236*b*, by the auxiliary inside edge restricting light shielding wall 248*b* located inwardly of the auxiliary lamp 246*b*; and the outside edge 252*b* of the light-irradiated area formed on the electrostatographic material 4 by the auxiliary lamp 246*b* is located on, or outwardly of, the inside edge 234*c* of the light-irradiated area formed on the electrostatographic material 4 by the light from the illuminating lamp 224*c*. In the illustrated embodiment, the outside edge 252*b* of the light-irradiated area formed on the electrostatographic material 4 by the light from the auxiliary lamp 246*b* is restricted within the light-irradiated area formed on the electrostatographic material 4 by the light from the illuminating lamp 224*b*, namely to a suitable position between its inside edge 234*c* and its outside edge 236*c*, by the auxiliary inside edge restricting light shielding wall 248*c* located outwardly of the auxiliary lamp 246*b*. Furthermore, it is important that the inside edge 250*c* of the light-irradiated area formed on the electrostatographic material 4 by the light leading from the auxiliary lamp 246*c* to the electrostatographic material 4 through the light transmission opening of the light shielding frame member 212 is restricted within the light-irradiated area formed on the electrostatographic material 4 by the light from the illuminating lamp 224*c*, namely to a suitable position between its inside edge 243*c* and its outside edge 236*c*, by the auxiliary inside edge restricting light shielding wall 248*c* located inwardly of the auxiliary lamp 246*c*, and the outside edge 252*c* of the light-irradiated area formed on the electrostatographic material 4 by the light from the auxiliary lamp 246*c* is located on, or outwardly of, the inside edge 234*d* of the light-irradiated area formed on the electrostatographic material by the light from the illuminating lamp 224*d*. In the illustrated embodiment, the outside edge 252*c* of the light-irradiated area formed by the light from the auxiliary lamp 246*c*, like the outside edge of the irradiated area by the light from the illuminating lamp 224*d*, is restricted by the side wall 218 or 220 of the light shielding frame member 212, but is beyond the side edge of the electrostatographic material 4.

When a copying paper having the size W-1 shown in FIG. 4 is used, all of the illuminating lamps 224*a*, 224*b*, 224*c* and 224*d* and all of the auxiliary lamps 246*a*, 246*b* and 246*c* are energized in the above charge eliminating lamp device 210. When the electrostatographic material 4 is located immediately below the first section 240 of the charge eliminating lamp device 210, the insufficiently light-irradiated portions N-1, N-2 and N-3 are formed as described with reference to FIGS. 2 and 3. It will be readily understood by referring to FIG. 4 however that when the electrostatographic material 4 moves with respect to the charge eliminating lamp device 210 and comes immediately below the second section 242 of the light shielding frame member 212, the light beams from the auxiliary lamps 246*a*, 246*b* and 246*c* are respectively irradiated onto areas containing the insufficiently light-irradiated portions N-1, N-2 and N-3, and consequently, the above insufficiently light-irradiated portions N-1, N-2 and N-3 are removed. When the copying paper used has a width shown by the symbol W-2 in FIG. 4, the illuminating lamps 224*a* and the auxiliary lamp 246*a* are not energized, but the illuminating lamps 224*b*, 224*c* and 224*d* and the auxiliary lamps 246*b* and 246*c* are energized. In this case, the light beams from the auxiliary lamps 246*b* and 246*c* are irradiated respectively onto areas containing the insufficiently light-irradiated portions N-2 and N-3, and consequently, the insufficiently light-irradiated portions N-2 and N-3 are removed. When the copying paper used has a width shown by the symbol W-3 in FIG. 4, the illuminating lamps 224*a* and 224*b* and the auxiliary lamps 246*a* and 246*b* are not energized, but the illuminating lamps 224*c* and 224*d* and the illuminating lamps 246*c* are energized. In this case, the light from the auxiliary lamp 246*c* is irradiated onto an area containing the insufficiently light-irradiated portion N-3, and consequently, the insufficiently light-irradiated portion N-3 is removed. When the copying paper used has a width shown by the symbol W-4 in FIG. 4, the illuminating lamps 224*a*, 224*b* and 224*c* and the auxiliary lamps 246*a*, 246*b* and 246*c* are not energized, and only the illuminating lamp 224*d* is energized.

Accordingly, the charge eliminating lamp device 210 improved in accordance with this invention makes it possible to sharpen the outside edges of the charged areas W-1, W-2, W-3 or W-4 on the electrostatographic material 4 sufficiently without generating the insufficiently light-irradiated portions N-1, N-2 and N-3, and therefore the insufficiently charge-eliminated portions.

Figure 6:
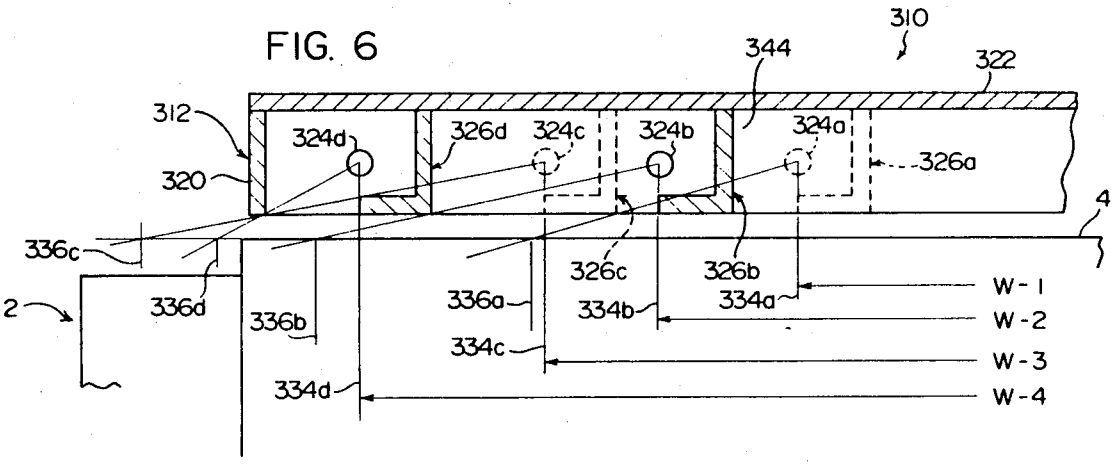
FIG. 6 is a sectional view showing one side portion of a second embodiment of the charge eliminating lamp device improved in accordance with this invention.
Figure 7:
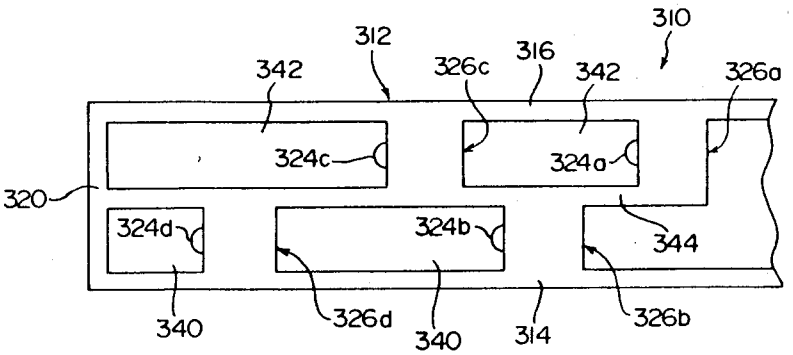
FIG. 7 is a bottom view of the charge eliminating lamp of FIG. 6.

FIGS. 6 and 7 show one side portion of a second embodiment of the charge eliminating lamp device improved in accordance with this invention (the other side portion of the second embodiment is substantially symmetrical to the one shown side as in the first embodiment described above).

The illustrated charge-eliminating lamp device shown generally at 310 has a light shielding frame member 312 supported in position by a suitable supporting means (not shown). The light shielding frame member 312 extends widthwise (in the left-right direction in FIGS. 6 and 7) along the surface of the electrostatographic material substantially parallel thereto along its nearly entire width. The light shielding frame 312 has a front wall 314 and a rear wall 316 positioned forwardly and rearwardly as viewed in the moving direction (the vertical direction in FIG. 7) of the electrostatographic material 4, and side walls 320 positioned on opposite sides in the width direction (only one of which is shown in FIGS. 6 and 7). The upper surface of the light shielding frame member 312 in FIG. 6 is closed by a cover plate 322. On the other hand, the lower surface of the light shielding frame member 312 in FIG. 6, namely that surface which faces the surface of the electrostatographic material 4, is opened and defines a light transmission opening permitting transmission of light.

A partitioning light shielding wall 344 which extends from the side end of the light shielding frame 312 inwardly in the width direction over a predetermined distance is disposed in each of the two side portions of the light shielding frame 312, and each of the two side portions of the light shielding frame member is partitioned into two sections in the moving direction of the electrostatographic material 4, i.e. a first section 340 and a second section 342, by the partitioning light shielding wall 344. A plurality of (four in the drawings) illuminating lamps 324*a*, 324*b*, 324*c* and 324*d* supported by suitable supporting means (not shown) are disposed alternately at suitable intervals in the width direction in the first section 340 and the second section 342. Specificallly, the illuminating lamps 324*a* and 324*c* are disposed within the second section 342, and the illuminating lamps 324*b* and 324*d*, within the first section 340. As viewed in the width direction, the illuminating lamp 324*b* is positioned between the illuminating lamps 324*a* and 324*c*, and the illuminating lamp 324*c*, between the illuminating lamps 324*b* and 324*d*.

Furthermore, in the first section 340 and the second section 342 existing in each of the two side portions of the light shielding frame member 312, inside edge restricting light shielding walls 326*a*, 326*b*, 326*c* and 326*d* are alternately disposed correspondingly to the illuminating lamps 324*a*, 324*b*, 324*c* and 324*d* respectively. The inside edge restricting light shielding walls 326*a* and 326*c* are disposed in the second section 342, and positioned respectively adjacent to the insides of the illuminating lamps 324*a* and 324*c*. The inside edge restricting light shielding walls 326*b* and 326*d* are disposed in the first section 340, and positioned correspondingly to the insides of the illuminating lamps 324*b* and 324*d* respectively. The structure of the inside edge restricting light shielding walls 326*a* to 326*d* may be substantially the same as that of the inside edge restricting light shielding walls 126*a* to 126*d* in the conventional charge eliminating lamp device 110 described hereinabove with reference to FIGS. 2 and 3. Furthermore, the positions in the width direction of the illuminating lamps 324*a* and 324*d* and the inside edge restricting light shielding walls 326*a* to 326*d* may be substantially the same as those of the illuminating lamps 124*a* to 124*d* and the inside edge restricting light shielding walls 126*a* to 126*d* in the conventional charge eliminating lamp device 110 described hereinabove with reference to FIGS. 2 and 3.

In the charge eliminating lamp device 310 described above, the illuminating lamps 324*a*, 324*b*, 324*c* and 324*d* and the accomapnying inside edge restricting light shielding walls 326*a*, 326*b*, 326*c* and 326*d* are disposed alternately in the first and second sections 340 and 342. Accordingly, as shown in FIG. 6, the light coming from the illuminating lamp 324*a* and reaching the electrostatographic material 4 through the light transmission opening of the light shielding frame member 312 is not shielded by the inside edge restricting light shielding wall 326*b* located immediately outwardly of the lamp 324 as viewed in the width direction, but can extend outwardly to a site restricted by the inside edge restricting light shielding wall 326*c* located outwardly of the inside edge restricting light shielding wall 326*b*. It is easy therefore to define the outside edge 336*a* of the light irradiated area on the electrostatographic material 4 by the light from the lamp 324*a* at, or outwardly of, the inside edge 334*b* of the light irradiated area on the electrostatographic material 4 by the light from the illuminating lamp 324*b*. Likewise, the light coming from the illuminating lamp 324*b* and reaching the electrostatographic material 4 through the light transmission opening of the light shielding frame 312 is not shielded by the inside edge restricting light shielding wall 326*c* positioned immediately outwardly of the lamp 324*b* as viewed in the width direction, but can extend to a site to be restricted by the inside edge restricting light shielding wall 326*d* located outwardly of the restricting light shielding wall 326*c*. Accordingly, it is easy to define the outside edge 336*b* of the light irradiated area on the electrostatographic material 4 by the light from the lamp 324*b* at, or outwardly of, the inside edge 334*c* of the light irradiated area on the electrostatographic material 4 by the light from the lamp 324*c*. Furthermore, the light coming from the lamp 324*c* and reaching the electrostatographic material 4 through the light transmission opening of the light shielding frame member 312 is not shielded by the inside edge restricting light shielding wall 326*d* located immediately outwardly of the lamp 324*c* as viewed in the width direction, but can extend outwardly to a site to be restricted by, for example, the side wall 320 of the light shielding frame member 312. It is easy therefore to define the outside edge 336*c* of the light irradiated area on the electrostatographic material 4 by the light from the lamp 324*c* at, or outwardly of, the light irradiated area on the electrostatographic material 4 by the light from the lamp 324*d*.

Owing to the aforesaid structure, the charge eliminating lamp device 310 shown in FIGS. 6 and 7 can avoid the formation of the insufficiently light-irradiated portions N-1, N-2 and N-3 (FIG. 2) described in regard to the conventional charge eliminating lamp device 110 shown in FIGS. 2 and 3 without the need for additional devices such as the auxiliary lamps 246*a*, 246*b* and 246*c* (FIGS. 4 and 5). It is possible therefore to adjust the width of the charged area on the electrostatographic material 4 to W-1 (the illuminating lamps 324*a*, 324*b*, 324*c* and 324*d* are energized), W-2 (the illuminating lamps 324*b*, 324*c* and 324*d* are energized), W-3 (the illuminating lamps 324*c* and 324*d* are energized) or W-4 (the illuminating lamp 324*d* is energized) without permitting the formation of an insufficiently charge-eliminated portion and while sharply defining the outside edge of the charged area on the electrostatographic material 4.

Figure 8:
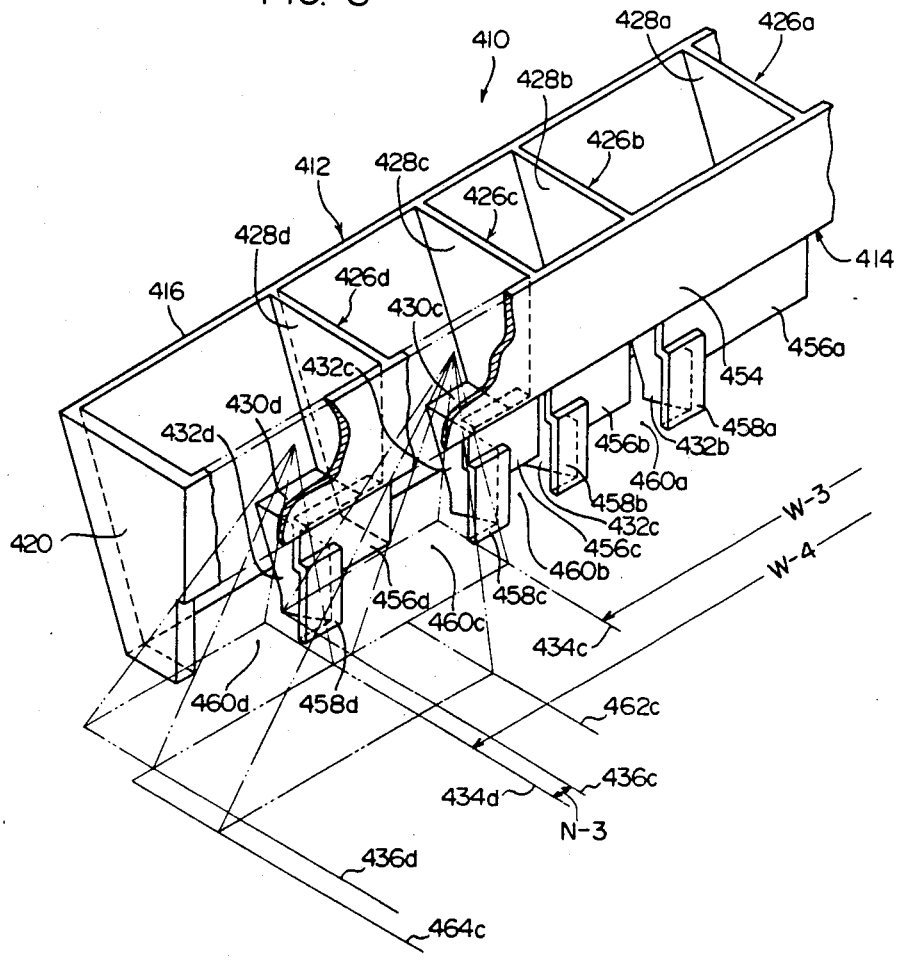
FIG. 8 is a perspective view, partly broken away, of one side portion of a third embodiment of the charge eliminating lamp device improved in accordance with this invention.
Figure 9:
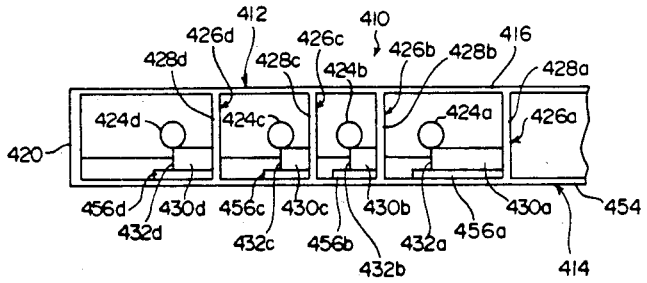
FIG. 9 is a top plan view of the charge eliminating lamp of FIG. 8.
Figure 10:
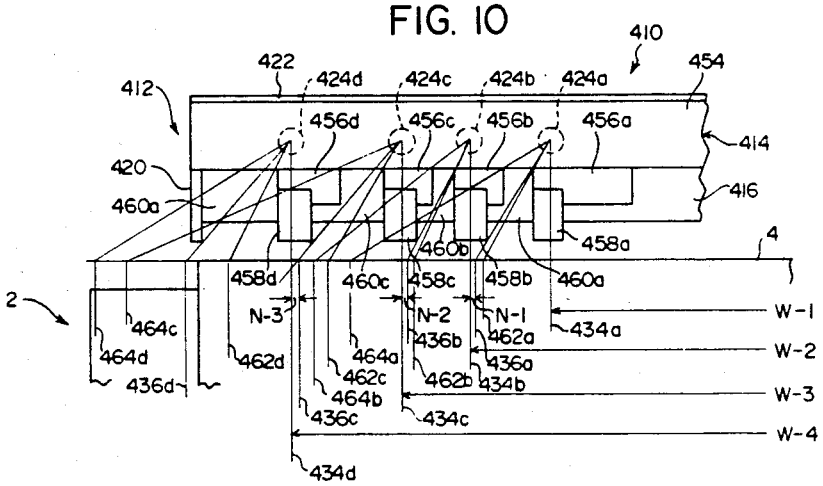
FIG. 10 is a front elevation of the charge eliminating lamp device of FIG. 8.

FIGS. 8, 9 and 10 shown one side portion of a third embodiment of the charge eliminating lamp device improved in accordance with this invention (the other side portion of the third embodiment is substantially symmetrical to the one side portion shown as is the case with the first and second embodiment described hereinabove).

The charge eliminating lamp device shown generally at 410 has a light shielding frame member 412 supported in position by a suitable supporting means (not shown). The light shielding frame member 412 extends along the surface of the electrostatographic material in its width direction (the left-right direction in FIGS. 9 and 10 substantially parallel along its nearly entire width). As clearly shown in FIG. 8, the light-shielding frame member 412 has a front wall 414 and a rear wall 416 located frontwardly and rearwardly as viewed in the moving direction (the vertical direction in FIG. 9) of the electrostatographic material 4 and side walls 420 positioned on opposite sides in the width direction (only one of the side walls is shown in FIGS. 8 to 10). The illustrated rear wall 416 is inclined downwardly in a direction gradually approaching the front wall 414. The front wall 414 will be described hereinbelow. The upper surface of the light shielding frame member 412 is closed by a cover plate 422 (see FIG. 10 because the cover plate 422 is omitted in FIGS. 8 and 9). The undersurface of the light shielding frame member 412, i.e. that surfaces which faces the surface of the electrostatographic material 4, is opened and defines a light transmission opening permitting transmission of light.

In each of the two side portions of the light shielding frame member 412, a plurality of (four in the drawings) illuminating lamps 424*a*, 424*b*, 424*c* and 424*d* (see FIGS. 9 and 10 because these lamps 424*a* to 424*d* are omitted in FIG. 8) are supported by a suitable supporting means (not shown) at suitable intervals in the width direction. Furthermore, in each of the two side portions of the light shielding frame member 412, a plurality of inside edge restricting light shielding walls 426*a*, 426*b*, 426*c* and 426*d* are disposed adjacent to the insides of these lamps 424*a*, 424*b*, and 424*c* and 424*d*, respectively. Each of the inside edge restricting light shielding walls 426*a*, 426*b*, 426*c* and 426*d* in the illustrated embodiment has a first portion 428*a*, 428*b*, 428*c* or 428*d* extending toward, and substantially perpendicularly to, the surface of the electrostatographic material 4, a second portion 430*a*, 430*b*, 430*c*, or 430*d* extending from the lower end of the first portion 428*a*, 428*b*, 428*c* or 428*d* outwardly in the width direction and substantially parallel (if desired, inclined downwardly) to the surface of the electrostatographic material 4, and a third portion 432*a*, 432*b*, 432*c* or 432*d* extending from the outside end, in the width direction, of the second portion 430*a*, 430*b*, 430*c* or 430*d* toward, and substantially perpendicular to, the surface of the electrostatographic material 4. The upper surfaces of the second portions 430*a*, 430*b*, 430*c* and 430*d* of the inside edge restricting light shielding walls 426*a*, 426*b*, 426*c* and 426*d* are located slightly above the lower edges of the rear wall 416 and the side walls 420. On the other hand, the lower ends of the third portions 432*a*, 432*b*, 432*c* and 432*d* of the inside edge restricting light shielding walls 426*a*, 426*b*, 426*c* and 426*d* project slightly downwardly beyond the lower edges of the rear wall 416 and the side walls 420. Conveniently, the outside ends, in the width direction, of the second portions 430*a*, 430*b*, 430*c* and 430*d* of the inside edge restricting light shielding walls 426*a*, 426*b*, 426*c* and 426*d* and the outside surfaces, in the width direction, of the third portions 432*a*, 432*b*, 432*c* and 432*d* are substantially in alignment respectively with the light emitting centers of the illuminating lamps 424*a*, 424*b*, 424*c* and 424*d* located outwardly of the inside edge restricting light shielding walls 426*a* to 426*d* as viewed in a direction substantially perpendicular to the surface of the electrostatographic material 4.

In the third embodiment of the charge eliminating lamp device improved in accordance with this invention, it is important that at least one of the front wall 414 and the rear wall 416 of the light shielding frame member 412 (the front wall 414 in the illustrated embodiment) should have at least one auxiliary light transmission opening. In the illustrated embodiment, the front wall 414 has a main portion 454 which extends continuously in the width direction of the electrostatographic material 4 but of which lower edge is located considerably above the lower edges of the rear wall 416 and the side walls 420. Furthermore, the front wall 414 has first suspending portions 456*a*, 456*b*, 456*c* and 456*d* and second suspending portions 458*a*, 458*b*, 458*c* and 458*d* disposed in relation to the inside edge restricting light shielding walls 426*a*, 426*b*, 426*c* and 426*d*, respectively. The first suspending portions 456*a*, 456*b*, 456*c* and 456*d* extend downwardly from the main portion 454 toward the surface of the electrostatographic material 4 at suitable intervals in the width direction of the electrostatographic material 4 and being slightly displaced toward the rear wall 416 with respect to the main portion 454. Conveniently, the widthwise inside edges of these first suspending portions 456*a*, 456*b*, 456*c* and 456*d* are substantially in alignment respectively with the first portions 428*a*, 428*b*, 428*c* and 428*d* of the inside edge restricting light shielding walls 426*a* to 426*d*. It is also convenient that the widthwise outside edge of the first suspending portions 456*a*, 456*b*, 456*c* and 456*d* are located slightly outwardly of the outside edges (the light emitting centers of the illuminating lamps 424*a*, 424*b*, 424*c* and 424*d*), in the width direction, of the second portions 430*a*, 430*b*, 430*c* and 430*d* of the inside edge restricting light shielding walls 426*a* to 426*d* in the width direction. Conveniently, the lower edges of the first suspending portions 456*a*, 456*b*, 456*c* and 456*d* are substantially in alignment with the under surfaces of the second portions 430*a*, 430*b*, 430*c* and 430*d*, respectively, of the inside edge restricting light shielding walls 426*a*, 426*b*, 426*c* and 426*d*. Each of the second suspending portions 458*a*, 458*b*, 458*c* and 458*d* extends downwardly toward the surface of the electrostatographic material 4 from each of the first suspending portions 456*a*, 456*b*, 456*c* and 456*d* while being slightly displaced forwardly. Conveniently, the widthwise inside edges of the second suspending portions 458*a*, 458*b*, 458*c* and 458*d* are in alignment respectively with the widthwise outside edges (and therefore, the light emitting centers of the illuminating lamps 424*a*, 424*b*, 424*c* and 424*d*) of the second portions 430*a*, 430*b*, 430*c* and 430*d* of the inside edge restricting light shielding walls 426*a*, 426*b*, 426*c* and 426*d*. It is also convenient that the widthwise outside edges of the second suspending portions 458*a*, 458*b*, 458*c* and 458*d* are in alignment respectively with the widthwise outside edges of the first suspending portions 456*a*, 456*b*, 456*c* and 456*d*. Furthermore, it is convenient that the lower end edges of the second suspending portions 458*a*, 458*b*, 458*c* and 458*d* are in alignment respectively with the third portions 432*a*, 432*b*, 432*c* and 432*d* of the inside edge restricting light shielding walls 426*a*, 426*b*, 426*c* and 426*d*.

Thus, in the illustrated embodiment, auxiliary light transmission openings are formed below the main portion 454 of the front wall 414. More specifically, between the inside edge restricting light shielding walls 426*a* and 426*b*, there exist the first suspending portion 456*a*, the second suspending portion 458*a*, and an inverted L-shaped auxiliary light transmission opening 460*a* defined between the first susptending portion 456*b* and the second suspending portion 458*b*. Likewise, the first suspending portion 456*b*, the second suspending portion 458*b*, and an inverted L-shaped auxilary light transmission opening 460*b* exist between the inside edges restricting light shielding walls 426*b* and 426*c*. Furthermore, between the inside edge restricting light shielding walls 426*c* and 426*d*, there exist the first suspending portion 456*c*, the second suspending portion 458*c*, and an inverted L-shaped auxiliary light transmission opening 460*c* defined between the first suspending portion 456*d* and the second suspending portion 458*d*. An auxiliary light transmission opening 460*d* also exists between the inside edge restricting light shielding wall 426*d* and the side wall 420 (the auxiliary opening 460*d* is not always necessary).

Let us assume that in the above charge eliminating lamp device 410, the auxiliary light transmission openings 460*a*, 460*b* and 460*d* are not present in the front wall 414 of the light shielding frame member. Then, the light beams from the illuminating lamps 424*a*, 424*b*, 424*c* and 424*d* will reach the surface of the electrostatographic material 4 by passing through only the light transmission opening present in the under surface of the light shielding frame member 412. In this case, as is the case with the conventional charge eliminating lamp device 110 described hereinabove with reference to FIGS. 2 and 3, the outside edge 436*a*, in the width direction, of the light irradiated area on the electrostatographic material 4 by the light from the illuminating lamp 424*a* is restricted to a site inwardly of the light irradiated area 434*b* on the electrostatographic material 4 by the light from the illuminating lamp 424*b*; the outside edge 436*b*, in the width direction, of the light irradiated area on the electrostatographic material 4 by the light from the illuminating lamp 424*b* is restricted to a site inwardly of the inside edge 434*c* of the light irradiated area on the electrostatographic material 4 by the light from the illuminating lamp 424*c*; and the outside edge 436*c*, in the width direction, of the light irradiated area on the electrostatographic material 4 by the light from the illuminating lamp 424*c* is restricted to a site inwardly of the outside edge 436*d* of the light irradiated area on the electrostatographic material 4 by the light from the illuminating lamp 424*d*. *As a result, insufficiently light-irradiated portions N-1, N-2 and N-3 are generated.*

In contrast, in the charge eliminating lamp 410, the auxiliary light transmission openings 460*a*, 460*b*, 460*c* (and 460*d*) are formed in the front wall 414 of the light shielding frame member 412. The light beams from the illuminating lamps 424*a*, 424*b*, 424*c* (and (424*d*) reach the surface of the electrostatographic material 4 by passing through the auxiliary light transmission openings 460*a*, 460*b*, 460*c* (and 460*d*). As can be easily understood by referring to FIG. 8, the light beams passing through the auxiliary light transmission openings 460*a*, 460*b*, 460*c* (and 460*d*) reach the surface of the electrostatographic material 4 while being displaced forwardly, as viewed in the moving direction of the electrostatographic material 4, with respect to the light-irradiated area formed by the light reaching the surface of the electrostatographic material 4 after passing through the light transmission opening formed in the under surface of the light shielding frame member.

It is important that a light irradiated-area formed on the electrostatographic material 4 by the light coming from the illuminating lamp 424*a* and reaching the surface of the electrostatographic material 4 through the auxiliary light transmission opening 460*a* should extend in the width direction from the inside edge 462*a* positioned between the inside edge 434*a* and the outside edge 436*a*, in the width direction, of the light-irradiated area formed on the electrostatographic material 4 by the light coming from the illuminating lamp 424*a* and reaching the surface of the electrostatographic material 4 through the light transmission opening, to the outside edge 464*a* positioned at, or outwardly of, the inside edge 434*b* of the light-irradiated area formed on the electrostatographic material 4 by the light coming from the illuminating lamp 424*b* and reaching the surface of the electrostatographic material 4 through the light transmission opening. Likewise, it is important that a light-irradiated area formed on the electrostatographic material 4 by the light coming from the illuminating lamp 424*b* and reaching the surface of the electrostatographic material 4 through the auxiliary light transmission opening 460*b* should extend in the width direction from the inside edge 462*b* positioned between the inside edge 434*b* and outside edge 436*b*, in the width direction, of the light-irradiated area formed on the electrostatographic material 4 by the light coming from the illuminating lamp 424*b* and reaching the surface of the electrostatographic material 4 through the light transmission opening, to the outside edge 464*b* positioned at, or outwardly of, the inside edge 434*c* of the light-irradiated area formed on the electrostatographic material 4 by the light coming from the illuminating lamp 424*c* and reaching the surface of the electrostatographic material through the light transmission opening. Furthermore, it is important that a light-irradiated area formed on the electrostatographic material 4 by the light coming from the illuminating lamp 424*c* and reaching the surface of the electrostatographic material 4 through the auxiliary light transmitting opening 460*c* should extend in the width direction from the inside edge 462*c* positioned between the inside edge 434*c* and outside edge 436*c*, in the width direction, of the light irradiated area formed on the electrostatographic material by the light coming from the illuminating lamp 424*c* and reaching the surface of the electrostatographic material through the light transmission opening, to the outside edge 464*c* positioned at, or outwardly of, the inside edge 434*d* of the light-irradiated area formed on the electrostatographic material 4 by the light coming from the illuminating lamp 424*d* and reaching the surface of the electrostatographic material through the light transmission opening. (It is also important that the inside edge 462*b*, in the width direction, of the light irradiated area formed on the electrostatographic material 4 by the light coming from the illuminating lamp 424*d* and reaching the surface of the electrostatographic material 4 through the auxiliary light transmission opening 460*d* should be positioned at, or outwardly of, the inside edge 434*d*, in the width direction, of the light-irradiated area formed on the electrostatographic material 4 by the light coming from the illuminating lamp 424*d* and reaching the surface of the electrostatographic material through the light transmission opening.)

Accordingly, the insufficiently light-irradiated portions N-1, N-2 and N-3 are erased respectively by the light coming from the illuminating lamp 424a and reaching the surface of the electrostatographic material 4 through the auxiliary light transmission opening 460*a*, the light coming from the illuminating lamp 424*b* and reaching the surface of the electrostatographic material 4 through the auxiliary light transmission opening 460*b*, and the light coming from the illuminating lamp 424*c* and reaching the surface of the electrostatographic material through the auxiliary light transmission opening 460*c*. Thus, according to the charge eliminating lamp device 410 shown in FIGS. 8 to 10, the insufficiently light-irradiated portions N-1, N-2 and N-3 (FIG. 2) described hereinabove with regard to the conventional charge eliminating device 110 illustrated in FIGS. 2 and 3 can be avoided without the need for additional devices such as the auxiliary lamps 246*a*, 246*b* and 246*c* (FIGS. 4 and 5) and therefore without involving an increase in cost, and also without the need to increase the size of the charge eliminating lamp device 410 in the moving direction of the electrostatographic material. Accordingly, the width of the charged area on the electrostatographic material 4 can be adjusted to W-1 (the illuminating lamps 424*a*, 424*b*, 424*c* and 424*d* are energized), W-2 (the illuminating lamps 424*b*, 424*c* and 424*d* are energized), W-3 (the illuminating lamps 424*c* and 424*d* are energized), or W-4 (the illuminating lamp 424*d* is energized) without generating insufficiently charge-eliminated portions while sharply defining the outside edge of the charged area on the electrostatographic material 4.

While the present invention has been described in detail hereinabove with reference to the accompanying drawings showing some specific embodiments of the charge eliminating lamp improved in accordance with this invention, it should be understood that various changes and modifications are possible without departing from the scope of this invention.

For example, in the illustrated embodiments, a single light shielding frame member extending along nearly the entire width of the electrostatographic material is used. If desired, however, separate light shielding frame members may be disposed respectively on both side portions of the electrostatographic material.

The charge eliminating lamp device improved in accordance with this invention has been described in relation to an electrostatic copying apparatus in which the width of a charged area is adjusted to a required value by eliminating charges in both side portions of the surface of the electrostatographic material. However, the charge eliminating lamp improved in accordance with this invention can also be applied to an electrostatic copying apparatus of the type in which the width of a charged area is adjusted to a required value by eliminating charges only in one side portion of the surface of the electrostatographic material, and in such a type of electrostatic copying apparatus, it is sufficient of course to dispose the charge eliminating lamp device only on one side of the electrostatographic material.

What is claimed is:

1. A charge eliminating lamp device comprising a light shielding frame member positioned in proximity to at least one side portion of the surface of an electrostatographic material from which an electric charge is to be eliminated, said frame member having a light transmission opening at that surface which faces the surface of the electrostatographic material, a plurality of illuminating lamps adapted to be selectively energized and disposed within said frame member in spaced-apart relationship in the width direction of the electrostatographic material, and a plurality of inside edge restricting light shielding walls within said frame member, said inside edge restricting light shielding walls being positioned adjacent to the insides of said illuminating lamps respectively as viewed in said width direction and adapted to restrict the inside edges, in said width direction, of light-irradiated areas formed on the electrostatographic material by said illuminating lamps; wherein each said inside edge restricting light shielding wall restricts the outside edge, in said width direction, of a light-irradiated area formed on the electrostatographic material by an illuminating lamp located inwardly of said inside edge restricting light shielding wall as viewed in said width direction to a site inwardly of the inside edge, in said width direction, of a light-irradiated area formed on the electrostatographic material by an illuminating lamp located outwardly of said inside edge restricting light shielding wall, and selctively energizable auxiliary lamps are disposed among said illuminating lamps in said width direction for irradiating an area on the electrostatographic material which ranges from its inside edge positioned between the inside edge and outside edge, in said width direction, of a light-irradiated area formed on the electrostatographic material by an illuminating lamp located inwardly of each said inside edge restricting light shielding wall in said width direction to its outside edge positioned at, or outwardly of, the inside edge, in said width direction, of a light-irradiated area formed on the electrostatographic material by an illuminating lamp located outwardly of said inside edge restricting light shielding wall in said width direction.

2. The charge eliminating lamp device of claim 1 wherein a partitioning light shielding wall extending in said width direction is disposed within said light shielding frame member for partitioning the inside of said frame member into two sections in the moving direction of the electrostatographic material; and said illuminating lamps and inside edge restricting light shielding walls are disposed in one of said sections and said auxiliary lamps, in the other.

3. The charge eliminating lamp device of claim 2 wherein auxiliary inside edge restricting light shielding walls are disposed within said other section of the frame member, said auxiliary light shielding walls being positioned respectively inwardly of said auxiliary lamps and adapted to restrict the inside edges, in said width direction, of light-irradiated areas formed on the electrostatographic material by the auxiliary lamps.

4. The charge eliminating lamp device of claim 3 wherein each of said auxiliary inside edge restricting light shielding walls is disposed between said inside edge restricting light shielding walls as viewed in said width direction.

5. The charge eliminating lamp device of claim 1 wherein each of said inside edge restricting light shielding walls has a first portion extending toward the surface of the electrostatographic material and a second portion extending outwardly in said width direction from the forward end of the first portion.

6. The charge eliminating lamp device of claim 5 wherein said first portion extends substantially perpendicularly to the surface of the electrostatographic material, and said second portion extends substantially parallel to the surface of the electrostatographic material.

7. The charge eliminating lamp device of claim 5 wherein the outside end of said second portion in said width direction is substantially in alignment, as viewed in a direction substantially perpendicular to the surface of the electrostatographic material, with the light emitting center of an illuminating lamp located outwardly of said inside edge restricting light shielding wall as viewed in said width direction.

8. A charge eliminating lamp device comprising a light shielding frame member positioned in proximity to at least one side portion of the surface of an electrostatographic material from which an electric charge is to be eliminated said frame member having a light transmission opening at that surface which faces the surface of the electrostatographic material, a plurality of illuminating lamps adapted to be selectively energized and disposed within said frame member in spaced-apart relationship in the width direction of the electrostatographic material, and a plurality of inside edge restricting light shielding walls within said frame member, said inside edge restricting light shielding walls being positioned adjacent to the insides of said illuminating lamps respectively as viewed in said width direction and adapted to restrict the inside edges, in said width direction, of light-irradiated areas formed on the electrostatographic material by said illuminating lamps; wherein a partitioning light shielding wall extending in said width direction is disposed in said frame member for partitioning the inside of said frame member into two sections in the moving direction of the electrostatographic material; and said illuminating lamps and inside edge restricting light shielding walls are disposed alternately in one and the other of said two sections, and the outside edge, in said width direction, of a light-irradiated area formed on the electrostatographic material by one of two illuminating lamps joining in said width direction which is located inwardly in said width direction is set at, or outwardly of, the inside edge, in said width direction, of a light-irradiated area formed on the electrostatographic material by the other illuminating lamp located outwardly in said width direction.

9. The charge eliminating lamp of claim 8 wherein each of said inside edge restricting light shielding walls has a first portion extending toward the surface of the electrostatographic material and a second portion extending outwardly in said width direction from the forward end of the first portion.

10. The charge eliminating lamp device of claim 9 wherein said first portion extends substantially perpendicularly to the surface of the electrostatographic material, and said second portion extends substantially parallel to the surface of the electrostatographic material.

11. The charge eliminating lamp of claim 9 wherein the outside end, in said width direction, of said second portion is substantially in alignment, as viewed in a direction substantially perpendicular to the surface of the electrostatographic material, with the light emitting center of the illuminating lamp positioned outwardly of the inside edge restricting light shield wall as viewed in said width direction.

12. A charge eliminating lamp device comprising a light shielding frame member positioned in proximity to at least one side portion of the surface of an electrostatographic material from which an electric charge is to be eliminated, said frame member having a light transmission opening at that surface which faces the surface of the electrostatographic material, a plurality of illuminating lamps adapted to be selectively energized and disposed within said frame member in spaced-apart relationship in the width direction of the electrostatographic material, and a plurality of inside edge restricting light shielding walls within said frame member, said inside edge restricting light shielding walls being positioned adjacent to the insides of said illuminating lamps respectively as viewed in said width direction and adapted to restrict the inside edges, in said width direction, of light-irradiated areas formed on the electrostatographic material by said illuminating lamps; wherein one or auxiliary light transmission openings are formed in at least one of the front and rear walls of said frame member which are located forwardly and rearwardly as viewed in the moving direction of the electrostatographic material, the outside edge, in said width direction, of a light-irradiated area formed on the electrostatographic material by the light coming from an illuminating lamp located inwardly of each said inside edge restricting light shielding wall as viewed in said width direction through said light transmission opening is restricted by said inside edge restricting light shielding walls to a site inwardly of the inside edge, in said width direction, of a light-irradiated area formed on the electrostatographic material by the light coming from an illuminating lamp located outwardly of said inside edge restricting light shielding walls through said light transmission opening, and a light-irradiated area formed on the electrostatographic material by the light coming from an illuminating lamp located inwardly of each said inside edge restricting light sheilding wall as viewed in said width direction through each said auxiliary light transmission opening extends from its inside edge positioned between the inside edge and outside edge, in said width direction, of a light-irradiated area formed on the electrostatographic material by the light coming from an illuminating lamp located inwardly of each of said inside edge restricting light shielding wall as viewed in said width direction through said light transmission opening to its outside edge positioned at, or outwardly of, the inside edge, in said width direction, of a light-irradiated area formed on the electrostatographic material by the light coming from an illuminating lamp located outwardly of each of said inside edge restricting light shielding walls as viewed in said width direction through said light transmission opening.

13. The charge eliminating lamp device of claim 12 wherein the auxiliary light transmission openings are spaced from each other in said width direction.

14. The charge eliminating lamp device of claim 13 wherein each of said auxiliary light transmission openings extends outwardly from a position spaced outwardly a predetermined distance in said width direction from the light emitting center of each of said illuminating lamps.

15. The charge eliminating lamp device of claim 12 wherein each of said inside edge restricting light shielding walls has a first portion extending toward the surface of the electrostatographic material and a second portion extending outwardly in said width direction from the forward end of said first portion.

16. The charge eliminating lamp device of claim 15 wherein said first portion extends substantially perpendicularly to the surface of the electrostatographic material, and said second portion extends substantially parallet to the surface of the electrostatographic material.

17. The charge eliminating lamp device of claim 15 wherein each of said inside edge restricting light shielding walls further has a third portion extending toward the surface of the electrostatographic material from the outside edge, in said width direction, of the second portion.

18. The charge eliminating lamp of claim 17 wherein said third portion extends substantially perpendicularly to the surface of the electrostatographic material.

19. The charge eliminating lamp of claim 15 wherein the outside end, in said width direction, of said second portion is substantially in alignment, as viewed in a direction substantially perpendicular to the surface of the electrostatographic material, with the light emitting center of an illuminating lamp located outwardly of said inside edge restricting light shielding wall as viewed in said width direction.

* * * * *